United States Patent [19]

Bloom

[11] 4,310,979

[45] Jan. 19, 1982

[54] BREAKAWAY DUAL-LEGGED SIGN SUPPORT

[75] Inventor: Jeffrey A. Bloom, Takoma Park, Md.

[73] Assignee: United States of America, Washington, D.C.

[21] Appl. No.: 31,681

[22] Filed: Apr. 19, 1979

Related U.S. Application Data

[63] Continuation of Ser. No. 860,527, Dec. 14, 1977, abandoned.

[51] Int. Cl.[3] ..... G09F 15/00

[52] U.S. Cl. ..... 40/607

[58] Field of Search ..... 40/602, 606, 607; 403/2, 11; 52/98, 38, 103

[56] References Cited

U.S. PATENT DOCUMENTS

| | | | |
|---|---|---|---|
| 3,866,367 | 2/1975 | Strizki | 40/697 |
| 4,071,970 | 2/1978 | Strizki | 40/607 |
| 4,171,919 | 10/1979 | Willis | 40/607 |

*Primary Examiner*—Gene Mancene

*Assistant Examiner*—Wenceslao J. Contrera

[57] ABSTRACT

A support post for a roadside sign that is designed to break easily when struck by a car, pivot up, and allow the car to pass under it. The hinge or pivot point is directly behind the vertical center of area of the sign, thereby eliminating the effects of wind which caused problems with the prior art design.

1 Claim, 3 Drawing Figures

BREAKAWAY DUAL-LEGGED SIGN SUPPORTGI

STATEMENT OF GOVERNMENT INTEREST

The present invention arose in the course of a government contract and may be manufactured and used by or for the government of the United States without the payment of any royalties thereon or therefor.

PRIOR APPLICATION

The present case is a continuation of Ser. No. 860,527 filed Dec. 14, 1977, now abandoned.

BACKGROUND

The posts which support signs, lights, etc. by the sides of highways have been determined to be hazards to automobiles which leave the paved portion of the highways. Eliminating the hazards by eliminating the posts is not possible, since the posts support items that are necessary to the use of the highway (i.e., lights at intersections, exit instructions, route number, etc.). Therefore the posts are designed to break readily under impact by a car, thereby allowing the car to roll to a controlled stop rather than crash into a rigid, unyielding post.

In the case of a post that supports a sign, however, wind loading on the sign presents a problem. A low wind pressure, acting on a large sign area, puts a substantial amount of stress on the support posts. If conventional posts are designed to break under impact by a car, it is possible that the wind loading will generate enough force to break the posts. Conversely, designing the posts to withstand the wind loading makes them too strong to break except under very high speed impacts; for low speed impacts they act as rigid barriers, and are the source of crash damage to the car and its occupants.

Accordingly, it is an object of the present invention to provide a support post for a sign that will break easily under the impact of a car but which will be impervious to wind loading.

It is a further object to provide such a post that can be easily and inexpensively repaired after impact.

SUMMARY

Briefly, the present invention is a sign post that is hinged so that it will "break" under impact by a car. The hinge point is directly behind the vertical center of area or vertical center of wind load of the sign so that wind loads act directly on the hinge.

DESCRIPTION OF THE PREFERRED EMBODIMENT

Figure 1:
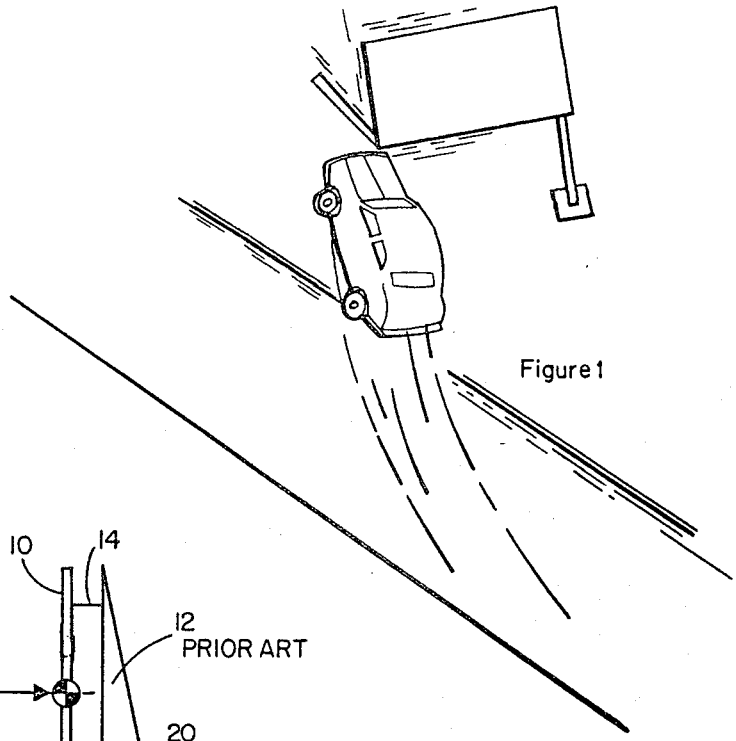
FIG. 1 shows the operation of a typical breakaway post under impact by a car.

FIG. 1 shows the operation of a typical breakaway post when it is struck by a car. When the car strikes the post, the inertia of the sign causes it to remain approximately stationary while the post "breaks" at its intended point as described below. The lower portion of the post then deflects up, allowing the car to pass underneath. Thus the post does not pose a crash hazard to the car.

Figure 2:
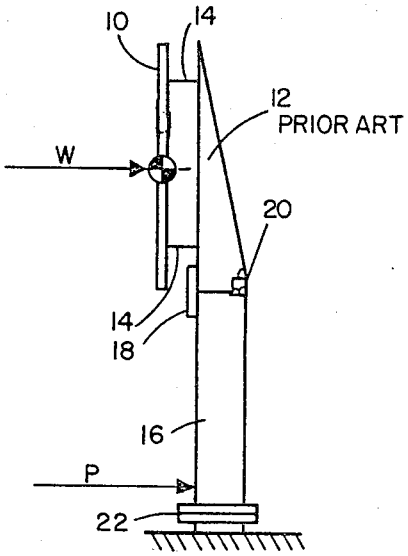
FIG. 2 shows a side view of a similar post of the prior art.

FIG. 2 shows the prior art post. Sign 10 is fastened to upper portion 12 by struts 14; upper portion 12 is fastened to lower portion 16 by "fuse" or slip plate 18 at its front side and by hinge 20 at its back side. Lower portion 16 is in turn fastened to the ground by a breakaway joint 22.

When the post is struck by a car, as shown by arrow P, breakaway joint 22 separates first; lower portion 16 then attempts to rotate about hinge 20, but this is resisted by fuse 18 which must be broken before lower portion 16 can rotate. Fuse 18 is necessary because of wind loading, shown by arrow W. Wind loads, shown as a force acting through the center of area of the sign, tend to rotate the sign clockwise about hinge 20. Fuse 18, which is a piece of metal, cable, etc. having one end fastened to upper portion 12 and the other end fastened to lower portion 16, resists this rotation. The problem with the prior art post lies with fuse 18. Fuse 18 should be rather weak so that it breaks easily when the post is struck by a car; however, it must also be strong enough to resist the wind loads imposed on the sign. Hence it is designed to resist the wind loads, which means it is too strong for the impact loads.

Figure 3:
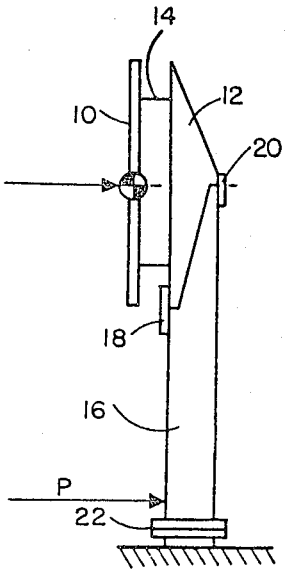
FIG. 3 shows a side view of the post of the present invention.

Applicant's post is shown in FIG. 3. As can be seen, hinge 20 has been moved up so that it is behind the vertical center of area or vertical center of wind load of the sign. Wind loads W now act through the pivot point, and do not exert any rotational force upon upper portion 12 and attached sign. In reality, however, the resultant wind loads do not act through a single point at all times and a small fuse 18 is still required. Now, however, the fuse can be much weaker than in the prior art design and lower portion 16 rotates out of the way more readily. Fuse 18 could be replaced by a slip plate or some other breakaway joint design. Either one can be used, since the force needed to cause "breaking" of the joint can be accurately predetermined in either case.

Hinge 20 can be either a solid piece of stock or a rotatable pin type hinge or any other design that allows rotation. However, from the standpoint of cost a solid piece of stock is preferable since it is cheaper.

The vertical placement of fuse or slip plate 18 is shown as being below the level of hinge 20, but this is not critical to the invention. It is placed as shown since this allows sign 10 to be attached entirely to upper portion 12; placing it higher would complicate the design by requiring another breakaway joint where the sign was attached to the lower portion of the leg, without giving any corresponding increase in performance of the breakaway leg.

It is possible that the leg could function without fuse or slip plate 18, but this is not the preferred embodiment. In practice a fuse or slip plate is necessary for two reasons: (1) wind loads are not always evenly distributed, hence there is sometimes some turning moment on the breakaway joint; and (2) after one leg has been hit by a car the fuse on the other leg helps that leg to hold the sign in place until the "broken" leg can be repaired.

After impact the "broken" leg is repaired by replacing the hinge (assuming that it is a solid piece of stock that has been bent by the impact), replacing the broken fuse or rebolting the slip plate, and then rebolting the slip plate at the base of the leg.

What is claimed is:

1. A support leg for a sign, comprising: an upper portion fixed to said sign, said upper portion having a front side facing said sign and a back side opposite said front side; a lower portion having corresponding front and back sides connected to said upper portion by a hinge, said hinge being in line with the vertical center of wind load on said sign and connecting said back sides of said upper and lower portions; a fuse joining said front sides of said upper and lower portions; and a breakaway joint connecting said lower portion to the ground.

* * * * *